United States Patent [19]

Schwär

[11] Patent Number: 4,800,683

[45] Date of Patent: Jan. 31, 1989

[54] GRINDING MACHINE FOR THE GRINDING OF ELONGATED WORKPIECES

[75] Inventor: Rudolf Schwär, Wuppertal, Fed. Rep. of Germany

[73] Assignee: Maschinenfabrik Ernst Thielenhaus GmbH, Wuppertal, Fed. Rep. of Germany

[21] Appl. No.: 20,288

[22] Filed: Feb. 27, 1987

[30] Foreign Application Priority Data

Mar. 20, 1986 [DE] Fed. Rep. of Germany ..... 3609409

[51] Int. Cl.[4] ..... B24B 5/42

[52] U.S. Cl. ..... 51/34 E; 51/77 R; 51/59 R; 51/165.81; 82/9

[58] Field of Search ..... 51/161, 59 R, 34 E, 51/67, 77 R, 165.8; 74/424.8 C; 82/9, 27

[56] References Cited

U.S. PATENT DOCUMENTS 1,909,033 5/1933 Yerkey ..... 51/77 R
3,214,991 11/1965 Perrin ..... 74/424.82
3,431,797 3/1969 Galbarini ..... 82/27
3,932,961 1/1976 Pagella ..... 51/165.8

FOREIGN PATENT DOCUMENTS 1652112 7/1971 Fed. Rep. of Germany .
3011454 4/1984 Fed. Rep. of Germany .

*Primary Examiner*—James G. Smith
*Assistant Examiner*—Blynn Shideler
*Attorney, Agent, or Firm*—Herbert Dubno

[57] ABSTRACT

The grinding toolholders of a grinding machine for the fine grinding or honing of a camshaft or other workpiece are displaced along nonrotatable threaded spindles by high-precision rotatable nuts which are driven by a stepping motor on each holder via a cog belt coupling all of the nuts of each holder with the stepping motor. This ensures synchronous drive of the nuts and allows narrow holders to be used to grind closely spaced zones without the danger of canting of the holders.

5 Claims, 3 Drawing Sheets

GRINDING MACHINE FOR THE GRINDING OF ELONGATED WORKPIECES

FIELD OF THE INVENTION

My present invention relates to a grinding machine and, more particularly to a grinding machine for the finished grinding and honing of elongated workpieces which have a plurality of spaced-apart ground regions, e.g. camshafts which can have a plurality of cams whose surfaces are to be ground and finished.

BACKGROUND OF THE INVENTION

It is known to provide machines, generally referred to as grinding machines, which are capable of grinding especially finished or fine grinding and honing of spaced-apart regions of a rotatable elongated workpiece such as the cams of a camshaft used in an internal combustion engine.

Such machines can comprise a workpiece support for rotating the workpiece and including, for example, a head stock and, if desirable, a tail stock, between which the workpiece is rotatably mounted on centers, and a tool carrier which has a plurality of grinding stones spaced apart along the axis of rotation of the workpiece and engageable with the respective zones, e.g. the cams of the workpiece to be finished.

The head stock can be provided with a drive for rotating the workpiece and the tool carrier can be formed with means for pressing the stones against the zones of the workpiece to be ground.

In the past, the means for pressing the stones against the workpiece have included a positioning motor or servomotor for displacing the workpiece holders along guides extending parallel to the axis of rotation of the workpiece, these holders being driven simultaneously by the aforementioned motor.

The system thus allows, as the stones are displaced parallel to the axis, a finished grinding of a number of zones of the workpieces so that all of these zones are formed with surfaces which are as parallel to the axis of the workpiece and thus the rotation axis as may be possible.

The guide elements along which the workpiece holders are shifted generally are rails and the workpiece holders are slides or are formed with slides which are displaceable along these rails with the usual travel play.

The slide displacement is effected by the positioning motor which can be a piston-and-cylinder arrangement and has its moving member displaceable in translation. This displacement is effected in the direction in which the workpiece holders are to be moved, i.e. parallel to the workpiece axis and hence the axis of rotation.

This requires for displacement parallel to the axis, proportionately long slides and associated with slides of increasing length, is an increasing danger of tilting of the slide because of the travel play of the slide which is required.

If, of course, the zones to be ground are relatively close together as is increasingly the case with modern internal combustion engines for automotive vehicles, the length of the slides may preclude simultaneous grinding of all of the surfaces.

In the latter case, the machining operation may require a number of machining steps with groups of cams of a camshaft being machined (ground) simultaneously but at different times from other groups of such cams or zones.

This, of course, results in further loss in precision.

In general, it is a significant disadvantage for modern computer-controller and numerically-controlled machinery that a given operation may require several steps at time-spaced intervals.

It is, therefore, the principal object of the present invention to provide an improved grinding machine for elongated workpieces having a multiplicity of axially-spaced zones to be ground whereby the aforementioned drawbacks are avoided.

Still another object of the invention is to provide a machine for the purposes described in which the workpiece holders can be as narrow as possible (as measured parallel to the axis) without introducing the danger of canting and like movements which might introduce inaccuracies, say that the holders can follow close on one another and thereby allow closely spaced zones or surfaces of the workpieces to be measured in a single operation.

Yet another object of the invention is to provide a grinding machine, especially for the fine or finished grinding or honing of cams of a camshaft of the type used in modern internal combustion vehicle engines, i.e. where the zones to be ground are relatively closely spaced.

SUMMARY OF THE INVENTION

These objects and others which will become more readily apparent hereinafter are attained, in accordance with my invention, in a grinding machine of the type described but wherein the guide elements for the tool holders are formed as threaded spindles which are focused against rotation on a support and thus traverse the tool holder or holders without rotating therein.

According to the invention, moreover, each tool holder is formed with a guide polygon, i.e. a structure having at least two vertices corresponding to the axes of such spindles and which defines a rigid structure guided along the spindles by the spindles. At each of these vertices, a respective rotatable nut is provided on the guide polygon and the nuts of each guide polygon are connected to a respective motor having an angularly displaceable output member for synchronously driving all of the nuts of the respective guide polygon.

This motor, hereinafter referred to as a positioning motor, can have an output element in the form of a rotatable shaft and can be a stepping motor or a so-called pulse motor, i.e. a high-torque rotary stepper motor which may be operated by a pulse train.

While it is possible to provide two spindles extending along the length of the machine and on which the respective tool holders are guided, preferably a minimum of three such spindles are provided so that the guide polygon has at least a triangular configuration although four or more spindles may be used if desired.

Three spindles are necessary for a statically determinate structure but it is also possible to provide, say four spindles in a statically indeterminate configuration.

The nuts which are used on each tool holder are preferably connected together and to the respective motor by an endless flexible belt, e.g. a cog belt, or a chain and sprocket wheel arrangement to minimize slip between the motor and the rotatable nuts or between and among the rotatable nuts of each tool holder.

It has been found to be advantageous to provide the nuts of a low-play and low-backlash type, i.e. nuts with roller-thread members in which the rollers with their respective threads engage the thread of the spindle within the casing of the respective nut. In this case, the roller thread members can be held under prestress to take up any play.

It has been indicated previously that motors of any type may be used as long as-they have an angularly displaceable output member. The preferred positioning motors are the stepping motors described since these can be controlled by a computer.

I should mention the fact that rotatable nuts with roller-thread members to limit play are known in commercial form and can, for example, result in an axial displacement of the nut relative to the spindle of, say, 1 mm per rotation, thereby ensuring especially high precisions.

Since angular displacements of the motor of less than one revolution can be accurately set, the entire displacement of the tool holder can be accomplished with a high degree of accuracy.

According to the invention, moreover, when the positioning motors are driven by a computer, it is possible to preprogram the computer to effect the desired displacements of the tool holders along the workpieces for a variety of workpieces, reading out the requisite signals upon selection of the workpiece which is to be machined. Tilting of the tool holders is completely excluded.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
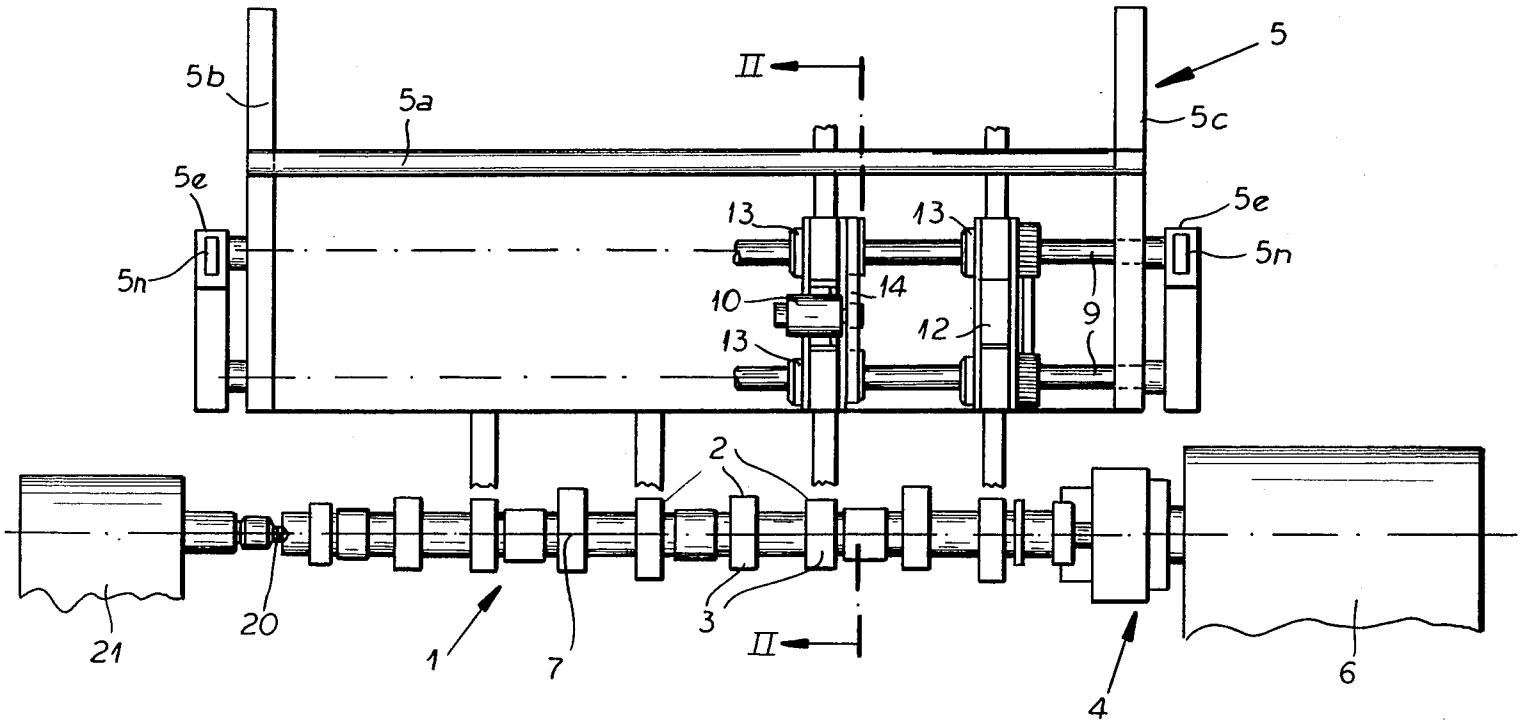
FIG. 1 is a side elevational view of a grinding machine according to the invention for the grinding of the cams of a camshaft for a vehicle internal combustion engine.

The grinding machine illustrated in the drawing is used for the fine grinding or honing of the individual cams 3 along respective zones 4 which are all intended to be parallel with one another and with the axis of rotation of a workpiece which is a camshaft 1.

The cam shaft, which can be of a type used in modern automotive vehicle engine applications, can have the cams relatively closely spaced.

The grinding machine comprises a head stock 6 formed with a chuck 4 in which one end of the camshaft is clamped and which rotates the camshaft about its axis. The other end of the camshaft is engaged by a live center 20 of a tail stock 21.

Each of the regions 2 which are to be ground, in accordance with the invention can be engaged between a pair of grinding or honing tools 11 which can be adjustably positioned replaceably in a pair of arms 8 of a workpiece holder which generally includes a structure 12 forming a guide polygon. A tool-carrying frame 5 can be provided to support a plurality (here four) threaded spindles 9 which are visible in FIG. 2 and which can include longitudinal members 5*a* bridging the end members 5*b* and 5*c* which are also connected by beams 5*d* visible in FIG. 2 but broken away in FIG. 1.

The supports 5*e* for the ends of the spindles 9 can be raised and lowered with respect to the plates 5*b* and 5*c* by fluid-operated cylinders 5*f* and 5*g* whose pistons 5*h* and 5*i* have forks 5*j* and 5*k* engaging eyes 5*m* and 5*n* of the supports 5*e*. This permits positioning of the tools 11 in the horizontal plane of the axis 7 (see FIG. 2).

Figure 2:
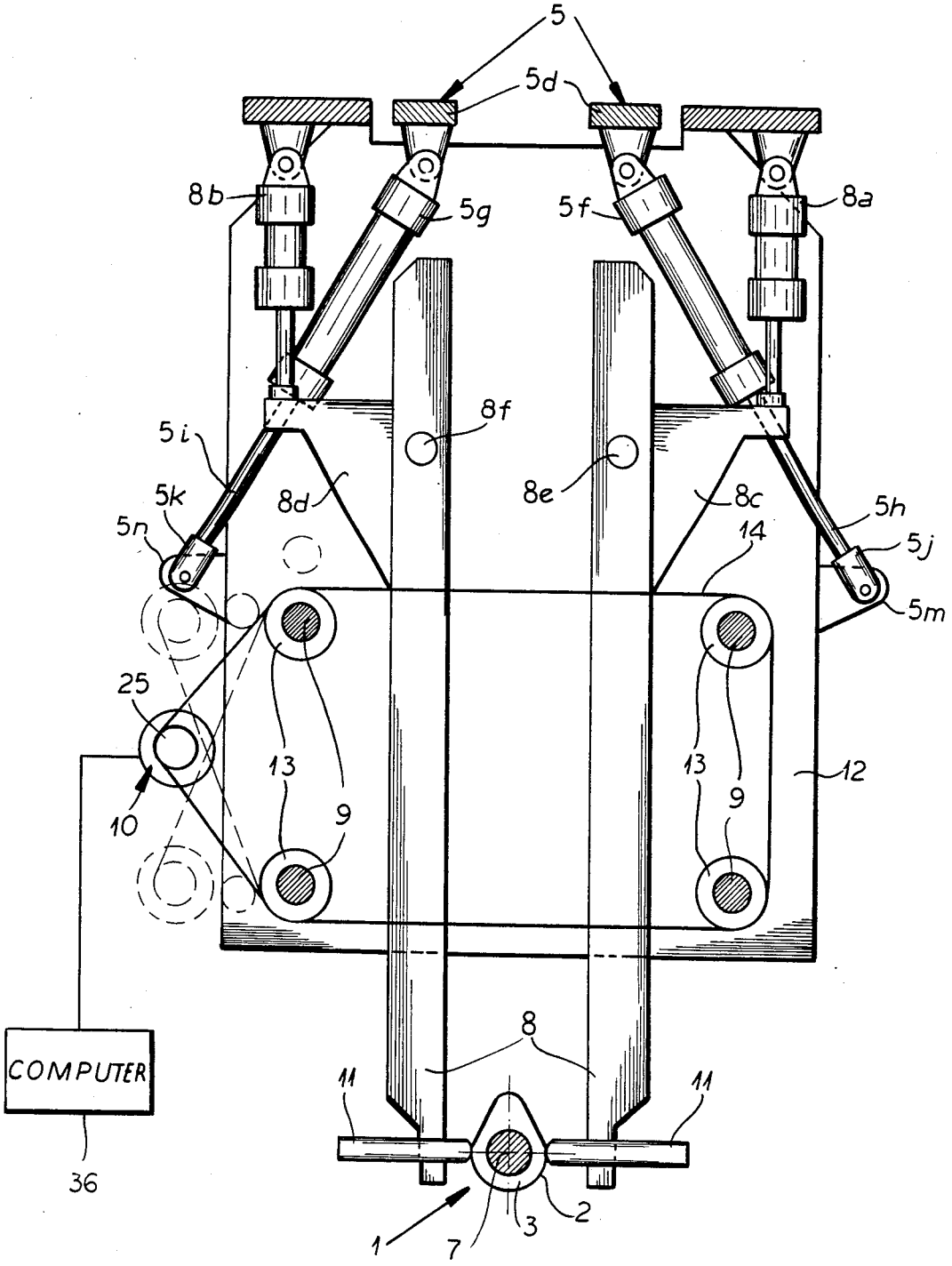
FIG. 2 is a diagrammatic section taken along the line II—II of FIG. 1.

Each holder 12 is also provided with a pair of cylinders 8*a*, 8*b* pivotally connected to the respective plate-like holder 12 and engaging lugs 8*c* and 8*d*, respectively attached to the arms 8 of the respective toolholder so as to pivot these arms about pins 8*e* and 8*f* to apply the desired grinding force radially inwardly to the tools 11 against the zones 2 of the cams 3 (FIG. 2).

The holders 12 can be referred to as guide polygons because they are guided along spindles 9 which have their axes disposed along the vertices of an imaginary polygon (formed by imaginary lines connecting the vertices).

Figure 3:
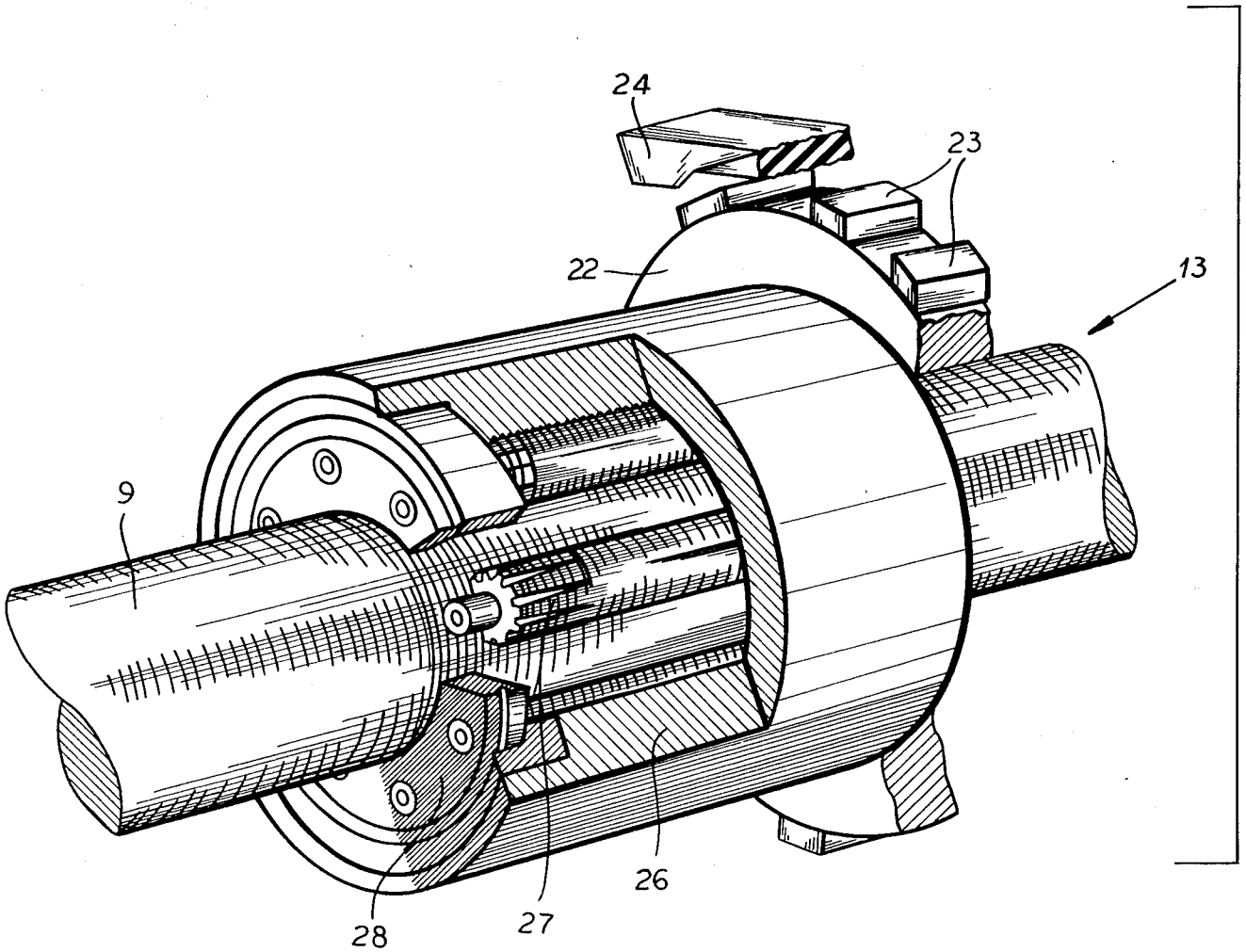
FIG. 3 is a perspective view, partly broken away of a threaded spindle used in the instant invention.

Journaled with a minimum of play on each plate along each of these axes is a respective rotary nut 13 and as can be seen from FIG. 3, each nut 13 can be formed with a cogwheel 22 whose teeth 23 mesh with the teeth 24 of a toothed belt 14 shown only diagrammatically in FIGS. 1 and 2.

The belt of each toolholder 8, 12, etc., passes around the wheels 22 of all of the precision nuts 13 which engage the respective spindles 9 with limited and generally zero axial play so as to synchronously displace these nuts in dependence upon the angular displacement of the output element, i.e. cogwheel 25 of a positioning motor 10. While the positioning motor is shown to be mounted symmetrically in FIG. 2, it can be shifted relatively upwardly or downwardly as illustrated in broken lines. The motor 10 is under the control of the computer 36 and may be operated by a pulse train from this computer, i.e. may be a stepper motor angularly incremented by each pulse from the computer.

Since all of the nuts 13 are driven simultaneously, there is no danger of canting of the toolholder 8, 12, etc. as it is displaced along the spindles. Furthermore, since the lengths of the nuts can be comparatively small, the toolholders can be spaced apart relatively closely so as to be able to grind closely spaced zones of the workpiece as is desirable for modern camshafts.

An alternative construction for the toolholders and the tool carrier is shown in German patent No. 16 52 112 and German open application No. 30 11 454. In this case, one need only substitute nonrotatable threaded spindles for the guide rails and rotatable nuts as described herein for the drive system utilizing a stepper motor as here described.

The nuts which are used, are, as noted, high precision nuts in which all axial play is taken up. This can be accomplished using a commercial nut construction generally of the type shown in FIG. 3 where the nut 13 has a casing 26 receiving a plurality of angularly equispaced threaded rollers 27 which engage the threads of the spindle 9 and which can be pressed axially relative to the casing 26 by a plate 28 so that the rollers 27 are axially stressed against the spindle 9 and the threads of the housing or casing 26.

The computer can be preprogrammed to adjust the grinding process for various camshafts as required.

I claim:

1. A grinding machine for an elongated workpiece having a plurality of zones axially spaced therealong to be ground simultaneously, said grinding machine comprising:

means for supporting said workpiece at its ends and for rotating said workpiece about an axis of rotation thereof;

a plurality of nonrotatable guide spindles extending parallel to said axis;

respective toolholders guided along said spindles and each formed with at least one tool engaging a respective one of said zones;

a plurality of high-precision low-play rotatable nuts operatively connected to each of said holders and threadedly engaging each of said spindles;

a respective positioning motor operatively connected with each of said holders and having an angularly displaceable output member; and means for operatively connecting said output member with said plurality of nuts of each holder comprising a cog belt means coupled to all of the nuts of the toolholder for synchronously driving said nuts to displace the respective holder along said spindles and cause the respective tool to grind the respective zone.

2. The grinding machine defined in claim 1 wherein four such spindles are provided and each of said holders has four of said nuts each threadedly engaging a respective one of said spindles.

3. The grinding machine defined in claim 1 wherein each of said nuts is provided with a plurality of roller thread members engaging the respective spindle, and means for stressing said roller thread members against the respective spindle.

4. The grinding machine defined in claim 3 wherein each of said motors is a stepping motor.

5. The grinding machine defined in claim 1 wherein each of said motors is a stepping motor.

* * * * *